US005934350A

United States Patent [19]

Ciuca

[11] Patent Number: 5,934,350

[45] Date of Patent: Aug. 10, 1999

[54] ADJUSTABLE TILT RESTRICTION FOR MINIBLINDS

[75] Inventor: Zazu G. Ciuca, Greensboro, N.C.

[73] Assignee: Newell Operating Company, Freeport, Ill.

[21] Appl. No.: 09/045,298

[22] Filed: Mar. 20, 1998

[51] Int. Cl.[6] ..... E06B 9/30

[52] U.S. Cl. ..... 160/176.1 R; 160/178.1 R

[58] Field of Search ..... 160/177 R, 176.1 R, 160/178.1 R, 168.1 R, 405, 166.1 R, 172 R, 173 R, 170 R, 171 R

[56] References Cited

U.S. PATENT DOCUMENTS

| | | | |
|---|---|---|---|
| 3,828,838 | 8/1974 | Anderle et al. | 160/176.1 R |
| 4,143,699 | 3/1979 | Marotto | 160/176.1 |
| 4,200,135 | 4/1980 | Hennequin | 160/176.1 X |
| 4,572,267 | 2/1986 | Stein et al. | 160/176.1 R |
| 5,031,681 | 7/1991 | Dodich | 160/176.1 R |
| 5,238,043 | 8/1993 | Woodring et al. | 160/176.1 X |

*Primary Examiner*—David M. Purol

*Attorney, Agent, or Firm*—Foley & Lardner

[57] ABSTRACT

A miniblind comprises a head rail, a tilt rod disposed within the head rail, a tilt actuator operatively connected to the tilt rod and operable to rotate the tilt rod, and a cam housing disposed in the head rail. The cam housing includes a cam non-rotatably connected to the tilt rod and rotating therewith, the cam having a protrusion, and at least one adjustable rotation restrictor extending within the housing, wherein rotation of the tilt rod is restricted by abutment of the cam protrusion against the at least one adjustable rotation restrictor. The cam housing includes at least one threaded bore extending therein from a side thereof to a position adjacent the cam, and at least one threaded member which can be adjusted to move along a length of the threaded bore. The bore is aligned with the at least one head rail aperture. The miniblind is adjusted by inserting a tool through the at least one head rail aperture and the at least one bore to engage the at least one threaded member to move the threaded member along the length of the threaded bore, thereby adjustably restricting rotation of the tilt rod by abutment of the cam protrusion against the at least one adjustable rotation restrictor.

19 Claims, 3 Drawing Sheets

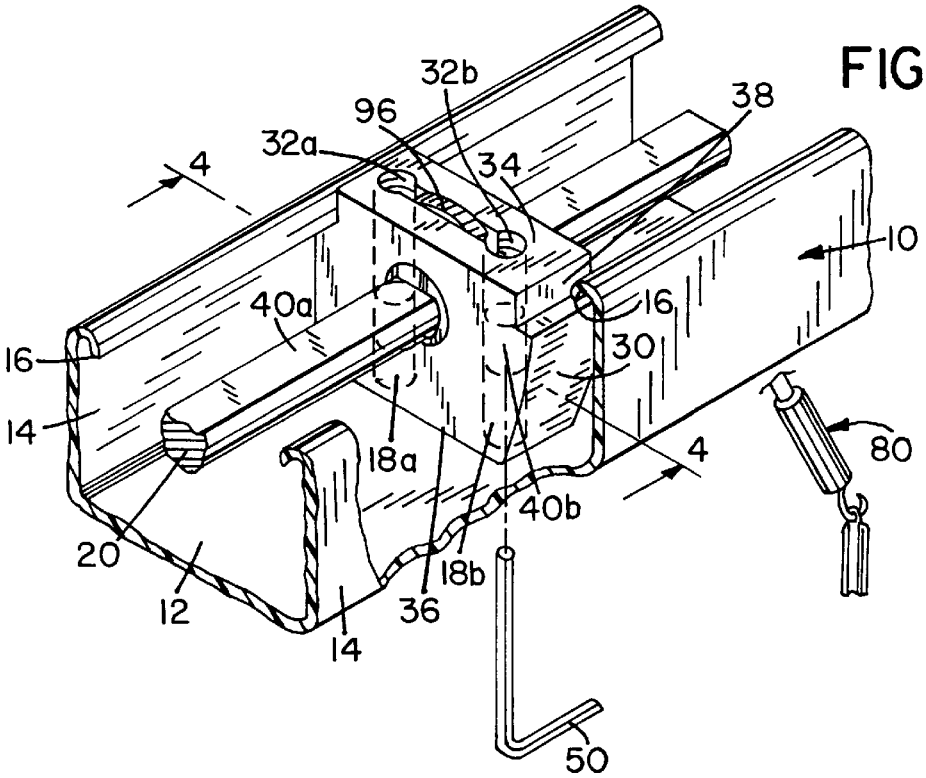
FIG. 2
FIG. 4
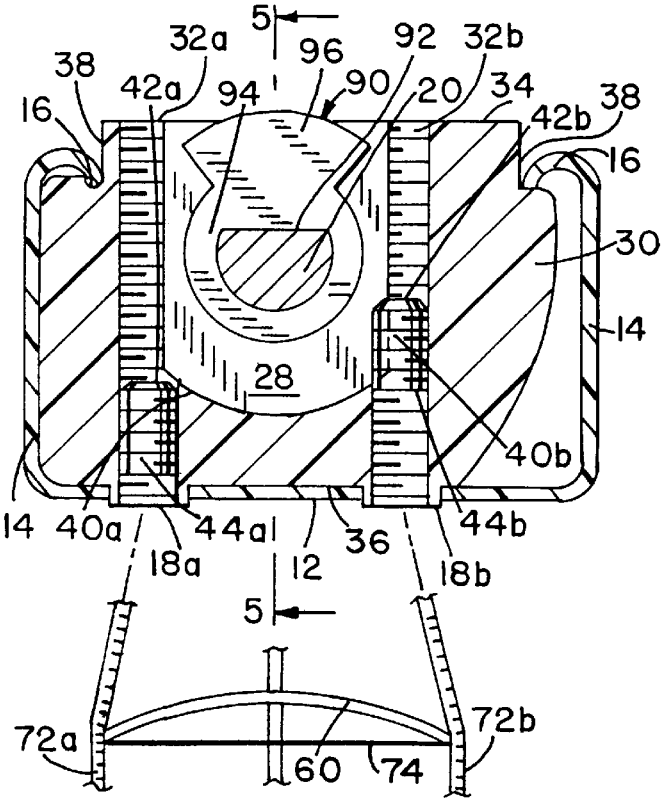
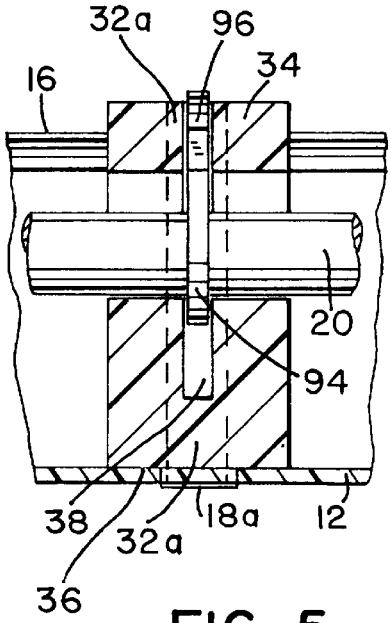
FIG. 5

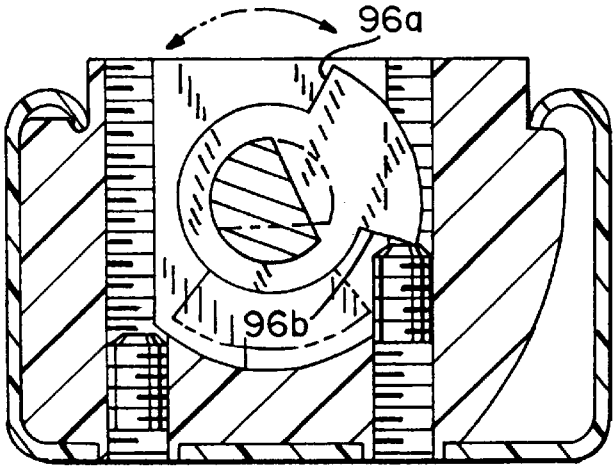
FIG. 6
FIG. 3
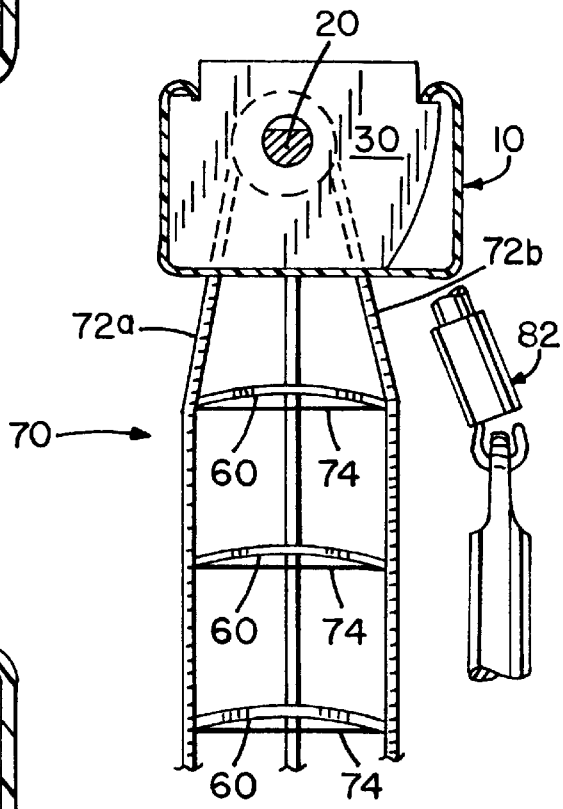
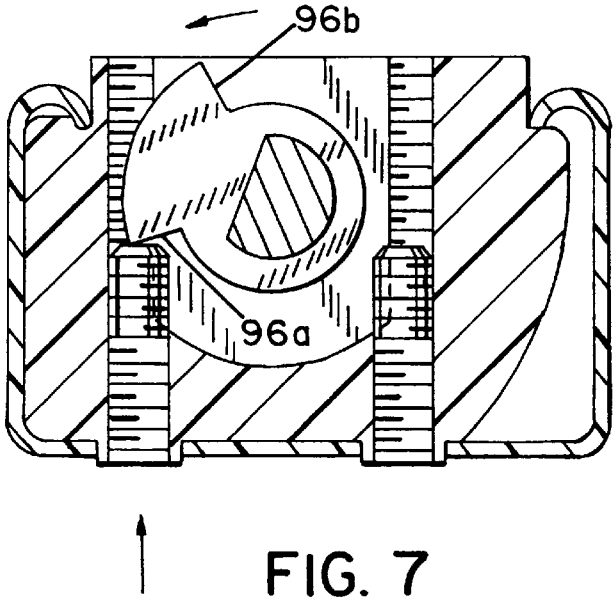
FIG. 7

ADJUSTABLE TILT RESTRICTION FOR MINIBLINDS

FIELD OF THE INVENTION

This invention relates generally to tilt mechanisms for miniblinds, and more particularly to a restricting tilt mechanism for miniblinds.

BACKGROUND OF THE INVENTION

Miniblinds comprise a plurality of parallel slats supported in a substantially horizontal array by flexible vertically aligned ladders. Each ladder comprises a pair of elongate flexible legs and a plurality of cross rungs extending between the legs. The ladders are interlaced with the slats such that the legs are disposed on opposite sides of the array of slats and such that each slat is supported by a cross rung of each ladder. The legs of each ladder extend upwardly beyond the array slats and into a head rail.

A tilt rod is rotatably mounted in the head rail. The tilt rod has drums fixedly mounted thereon which are aligned with the ladders. The legs of each ladder extend into the head rail and are wrapped in opposite directions around the drum. Therefore, rotation of the tilt rod about its axis causes a corresponding rotation of the drum and associated longitudinal movement of the ladder legs mounted to each drum. In particular, rotation of the tilt rod causes one leg in each ladder to move upwardly while the other leg moves downwardly. This relative shifting of the legs causes an angular alignment of the cross rungs in each ladder to change, thereby causing the slats resting on the cross rungs to rotate in unison about their respective longitudinal axes.

A tilt control actuator extends from the head rail and is operatively connected to the tilt rod. The tilt control actuator rotates the tilt rod.

In theory, the slats can be tilted through an angle approaching 180°. In particular, the slats may be rotated almost 90° in one direction from the horizontal alignment such that a top convex surface of each slat is facing into the room in which the miniblinds are mounted. Alternatively, the miniblinds can be rotated almost 90° in an opposite direction from their horizontal alignment such that a bottom concave surface of each slat is facing into the room in which the miniblinds are mounted.

One problem associated with known miniblinds is that excessive tilting of the slats could cause the miniblinds to jam. Additionally, many architectural applications of miniblinds specify controls on the tilt of miniblinds to provide a more uniform exterior appearance for the building and/or alignment of light into the building. For example, an architect may specify that miniblinds be adjustable such that only the top convex surface of each slat is viewable from the exterior of the building. Similarly, the architect may specify that the slat alignments limit vision of unsightly roadways or parking lots. Therefore, some prior art blinds include means for limiting the amount of tilt. The range of acceptable miniblind tilts may vary throughout the building.

It is known to control the amount of tilt by non-rotatably mounting a tilt control cam to a tilt rod. For instance, commonly owned U.S. Pat. No. 3,828,838 discloses tilt restriction using a generally circular tilt control cam having flat edges which abut a stop member to limit turning of the tilt control cam and the tilt rod. The flattened surface of the cam limits rotation in either direction. Varied cam configurations are provided and replacement of the cam is required to vary the amount of tilting that can take place. The tilt rod and the tilt control cam reside in a head rail. To vary the amount of tilt possible, it is necessary to replace the tilt control cam, which is only accessible from an open top of the head rail. Therefore, it may be necessary to remove the miniblind from the window to replace the tilt control cam and vary the amount of tilt.

Commonly owned U.S. Pat. No. 5,031,681 also teaches tilt restriction. Similar to U.S. Pat. No. 3,828,838, the cam is generally circular and is non-rotatably mounted to a tilt rod. A flat surface of the tilt control cam abuts a stop member. In the disclosure of U.S. Pat. No. 5,031,681, however, each tilt control cam limits rotation in a single direction, and therefore two tilt control cams are generally needed. U.S. Pat. No. 5,031,681 does not disclose alternative tilt control cam embodiments to vary the amount of tilting that can take place.

Other known tilt restriction mechanisms include a tilt control cam non-rotatably mounted to the tilt rod and having a protrusion that moves in an arcuate slot as the tilt rod is rotated. The amount of tilting that can take place is limited by permanently securing rivets within the slots to obstruct passage of the protrusion through the slot beyond the rivets. To vary the amount of tilting that can take place, the rivets must be removed and new rivets must be applied. The rivets are only accessible from an open top of the head rail. Therefore, it is likely necessary to remove the miniblind from the window to gain access to the tilt control cam.

Although the prior art tilt control cams have worked adequately, they do not allow for variation of the amount of tilting that can take place, or they require a labor-intensive procedure for altering the amount of tilting that can take place. In addition, the miniblind must be removed from the window to alter the tilt control mechanism to vary the amount of possible tilting. A skilled installer may be needed, and a variety of tools may be required. Replacement cams may be misplaced, and can be costly to purchase as needed. It could be confusing and error-prone to install miniblinds in a building such that different areas of the building require a different range of tilt. In this case, one must place the correct cam into each miniblind prior to installation. When tilt is restricted with rivets, removing rivets is complicated and could cause the plate on which the rivets are attached to break, therefore requiring replacement of the riveted plate and perhaps the entire tilt control mechanism, which would be labor-intensive and costly.

In addition to installation problems, it has been noted in the industry that tolerance cannot be held to a precise, finite measurement for the size, shape and placement of many of the elements of the miniblind, including the tilt control cam, the stop member which the tilt control cam abuts, the retainer, the tilt rod, the head rail, the ladder headloop, the tilt actuator and the drum. These components, when measured within their respective tolerance limits, can change the open and close positions significantly, sometimes more than 20°. With each combination of the above-listed elements, a different angle is obtained, and the product may not meet the customer's expectations.

SUMMARY OF THE INVENTION

Therefore, it is an object of the present invention to provide a tilt control mechanism requiring a single tilt control stop or cam which restricts tilt in both rotational directions of the tilt rod.

It is a further object of the present invention to provide a tilt control mechanism which allows variation of the amount of tilting in a quick and simple manner, without requiring removal of the miniblind from the window in which it is mounted.

It is a further object of the present invention to provide a tilt control mechanism which allows variation of the amount of tilting using a single tool.

It is still another object of the present invention to provide a tilt control mechanism which allows variation of the amount of tilting without requiring replacement of parts of the tilt control mechanism.

It is still another object of the present invention to provide a tilt control mechanism which allows simple adjustment of the mechanism to correct undesirable variations from the expected miniblind open and closed positions, and to allow more precise control of the tilt range of the miniblind.

According to one aspect of the present invention, there is provided a miniblind comprising a head rail, a tilt rod disposed within the head rail, a tilt actuator operatively connected to the tilt rod and operable to rotate the tilt rod, and a stop or cam housing disposed in the head rail. The cam housing includes a stop or cam non-rotatably connected to the tilt rod and rotating therewith, the cam having a protrusion, and at least one adjustable rotation restrictor extending within the housing, wherein rotation of the tilt rod is restricted by abutment of the cam protrusion against the at least one adjustable rotation restrictor.

According to another aspect of the present invention, there is provided a tilt actuator for use in a miniblind having a plurality of slats. The tilt actuator adjusts the minimum and maximum tilt angle of the slats and comprises a head rail, a tilt rod disposed within the head rail, a tilt actuator operatively connected to the tilt rod and operable to rotate the tilt rod, and a stop or cam housing disposed in the head rail. The cam housing includes a cam or stop non-rotatably connected to the tilt rod and rotating therewith, the cam having a protrusion, and at least one adjustable rotation restrictor extending within the housing, wherein rotation of the tilt rod is restricted by abutment of the cam protrusion against the at least one adjustable rotation restrictor.

According to still another aspect of the present invention, there is provided a method of adjusting tilt range restriction of a miniblind having a head rail with at least one aperture, a tilt rod extending within the head rail, and a tilt actuator operatively connected to the tilt rod and operable to rotate the tilt rod. The method comprises providing a cam or stop housing disposed in the head rail. The cam housing includes a stop or cam non-rotatably connected to the tilt rod and rotating therewith. The cam has a protrusion and at least one adjustable rotation restrictor extending within the housing. The adjustable rotation restrictor includes at least one threaded bore extending into the cam housing from a side thereof to a position adjacent the cam, and at least one threaded member which can be adjusted to move along a length of the threaded bore. The bore is aligned with the at least one head rail aperture. The method further includes inserting a tool through the at least one head rail aperture and the at least one bore to engage the at least one threaded member, actuating the at least one threaded member with the tool such that the threaded member moves along the length of the threaded bore, and restricting rotation of the tilt rod by abutment of the cam protrusion against the at least one adjustable rotation restrictor.

Other advantages of the invention will become apparent from the detailed description given hereinafter. It should be understood, however, that the detailed description and specific embodiments are given by way of illustration only. Based on the following description, various changes and modifications within the spirit and scope of the invention will become readily apparent to those skilled in the art.

BRIEF DESCRIPTION OF THE DRAWINGS

The preferred exemplary embodiment of the invention will hereinafter be described in conjunction with the appended figures, in which like reference numerals denote like elements, and:

FIG. 2 shows a perspective view of a head rail of the present invention;

FIG. 3 shows a side view of a head rail of the present invention having an attached ladder and slat arrangement;

FIG. 4 is a cross sectional view of the head rail of the present invention, taken along line 4—4 of FIG. 2;

FIG. 5 is a sectional view of the head rail of the present invention, taken along line 5—5 of FIG. 4;

FIG. 6 is a view as in FIG. 4, showing rotation of the cam or stop to a first abutting position; and FIG. 7 is a view as in FIG. 4, showing rotation of the cam or stop to a second abutting position.

DETAILED DESCRIPTION OF THE PREFERRED EMBODIMENT

Figure 1:
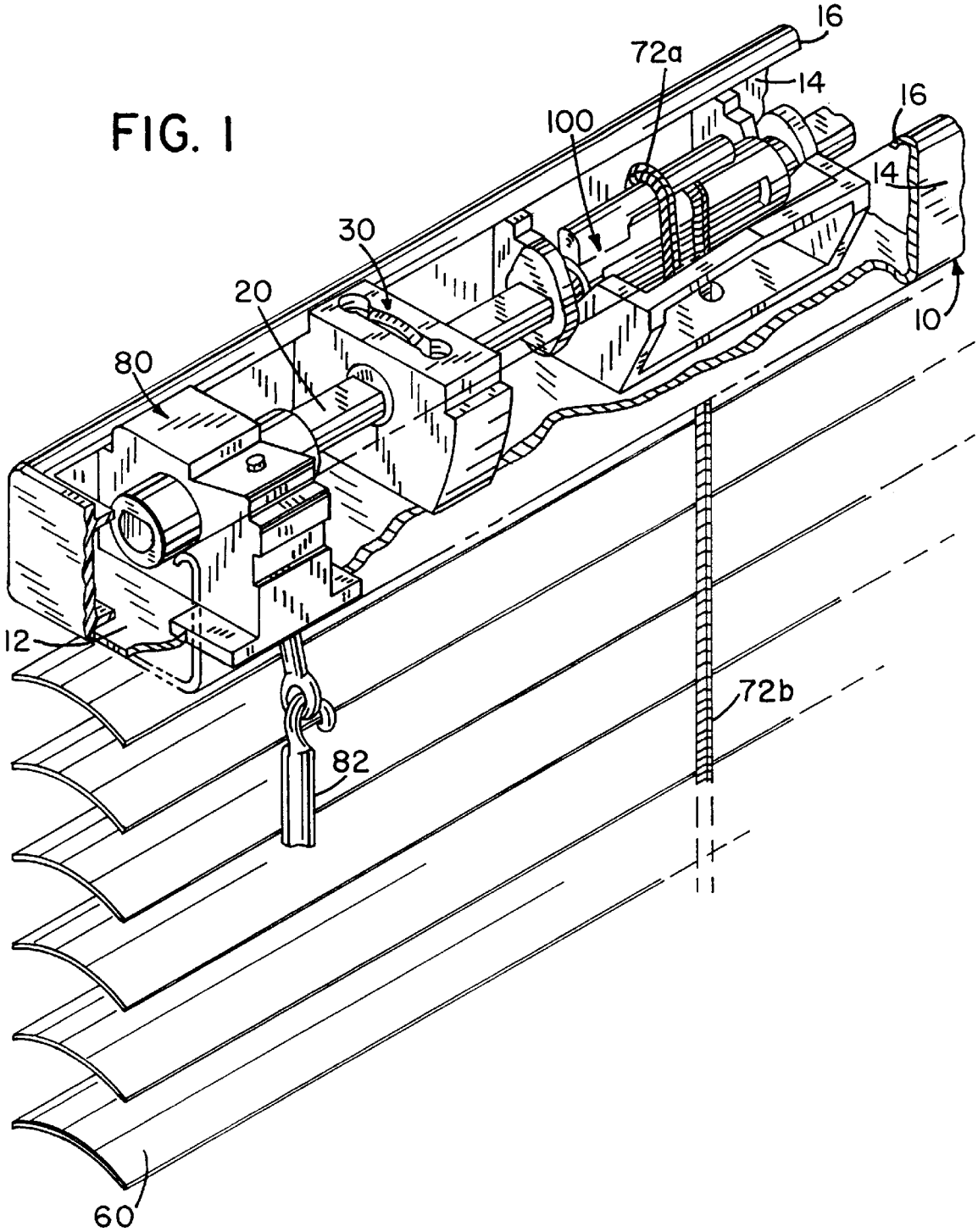
FIG. 1 shows a perspective view of a blind having a head rail of the present invention.

FIG. 1 illustrates a blind with an elongate head rail 10. At an outermost end of head rail 10, a tilt actuator 80 is supported within head rail 10 and is operatively connected to tilt rod 20. An actuator rod 82 is operable to rotate tilt rod 20, preferably through actuation of a worm gear mechanism (not shown). Spaced inward from tilt actuator 80 along a longitudinal axis of tilt rod 20, is a housing 30 which houses a tilt restriction mechanism. The tilt restriction mechanism is discussed in detail hereinafter with reference to FIGS. 2 and 4–7. Spaced inward from housing 30 along a longitudinal axis of tilt rod 20, is a drum 100 around which legs 72*a*, 72*b* of the blind are wrapped such that tilting of tilt rod 20 tilts drum 100 with tilt actuator 80, which causes longitudinal movement of legs 72*a*, 72*b* to adjust the tilt of the blind slats 60. Arrangement of the legs and slats is discussed hereinafter with reference to FIG. 3.

Referring to FIG. 2, a more detailed illustration is made of housing 30. An elongate head rail 10 preferably has a generally U-shaped cross section, including a bottom wall 12 and two side walls 14. The head rail preferably comprises a plastic material such as nylon, but may alternatively comprise a metal such as steel, or another suitable material. A housing 30 is mounted on opposite ends of head rail 10 (only one end illustrated). Each housing 30 extends between side walls 14 of head rail 10 and is supported by bottom wall 12 of head rail 10. Housing 30 has a top surface 34 and a bottom surface 36. Top surface 34 of housing 30 includes cut-out portions or grooves 38 adjacent side walls 14 of head rail 10. Curved end portions 16 of side walls 14 curve into grooves 38 and abut grooves 38 in a downward direction to hold the housing within the head rail. Housing 30 preferably comprises a plastic material, but may comprise a metal or other suitable material.

A tilt rod 20 is pivotally mounted to project though a central portion of each housing 30 and is supported by each housing 30 such that it extends along a length of head rail 10 between side walls 14 of head rail 10. Tilt rod 20 is mounted such that it may pivot along its longitudinal axis. Tilt rod 20 preferably has a D-rod cross-section shape but may alternatively have a V-rod cross-section shape or any other cross-section shape such that non-rotatable mounting is possible. Tilt rod 20 preferably comprises a metal material such as steel, but may comprise a suitable plastic or other material as well.

Two cylindrical bores 32*a*, 32*b* extend through housing 30, preferably in a vertical direction. Bores 32*a*, 32*b* preferably are located within the housing such that they run from a top surface 34 of housing 30 to a bottom surface 36 of housing 30, and between the centrally mounted tilt rod 20 and side walls 14 of head rail 10. Bores 32*a*, 32*b* may also extend upward from bottom surface 36 through about one half or three quarters of the length of housing 30. Bores 32*a*, 32*b* are preferably threaded. In a particularly preferred embodiment of the invention, the pitch of the bore threading is 8/32 inch.

A cylindrical adjustable rotation restrictor 40*a*, 40*b* is located within each bore 32*a*, 32*b*. The length of the adjustable rotation restrictors is preferably less than half the length of the bore, such that they can be moved to a broad range of positions within their respective bores 32*a*, 32*b*. The adjustable rotation restrictors 40*a*, 40*b* are preferably threaded and can be actuated to move along their respective bore 32*a*, 32*b*. In a particularly preferred embodiment, adjustable rotation restrictors 40*a*, 40*b* are 8/32 inch metal or plastic set screws. Adjustable rotation restrictors 40*a*, 40*b* may be actuated by a tool 50 to move along their respective bores 32*a*, 32*b*. In a preferred embodiment, tool 50 is a hex key (more specifically an 8/32 inch hex key), but may be another type of tool such as a flat head or phillips head screwdriver, or a socket wrench. Tool 50 must have a length sufficient to be inserted through bores 32*a*, 32*b*, engage the adjustable rotation restrictors and move adjustable rotation restrictors 40*a*, 40*b* through a broad range of positions within their respective bores 32*a*, 32*b*. Bottom surface 44*a*, 44*b* of the adjustable rotation restrictors 40*a*, 40*b* are adapted to engage tool 50 and be actuated by tool 50. In a preferred embodiment, tool 50 accesses adjustable rotation restrictors 40*a*, 40*b* from bottom surface 36 of housing 30 through respective bores 32*a*, 32*b*. Head rail 10 has an access, in the illustrated instance two apertures 18*a*, 18*b* aligned with bores 32*a*, 32*b*, respectively, which allows tool 50 to be inserted into bores 32*a*, 32*b* and engage adjustable rotation restrictors 40*a*, 40*b*. In this manner, the extent of rotation of the tilt rod 20 is adjustable externally of the head rail 10 whether or not the head rail is mounted.

As shown in FIG. 3, each side of head rail 10 includes a flexible, vertically aligned ladder 70. A plurality of parallel slats 60 are supported in a substantially horizontal array by ladder 70. Ladder 70 comprises elongate flexible legs 72*a*, 72*b* and a plurality of cross rungs 74. Ladder 70 is interlaced with slats 60 such that each slat 60 is supported by a cross rung 74 of ladder 70. Legs 72*a*, 72*b* of ladder 70 extend upwardly beyond slats 60 and into head rail 10, and are wrapped in opposite directions around tilt rod 20 (via drum 100, which is not shown in FIG. 3). Therefore, rotation of tilt rod 20 about its axis causes a corresponding longitudinal movement of legs 72*a*, 72*b*. In particular, rotation of tilt rod 20 causes one leg in each ladder 70 to move upwardly while the other leg moves downwardly. For example, referring to FIG. 3, clockwise rotation of tilt rod 20 will cause leg 72*b* to move downwardly and leg 72*a* to move upwardly. This relative shifting of legs 72*a*, 72*b* causes an angular alignment of cross rungs 74 in each ladder 70 to change, thereby causing slats 60 resting on cross rungs 74 to rotate in unison, in a clockwise direction, about their respective longitudinal axes.

Referring to FIGS. 4 and 5, a stop or cam 90 is located within the housing. The cam 90 is connected to tilt rod 20, such that cam 90 rotates with tilt rod 20 when tilt rod 20 is actuated by tilt actuator 80. Cam 90 has a circular base 94 with a centrally located aperture 92 for insertion of tilt rod 20. Aperture 92 preferably has the same shape as tilt rod 20 and is of a size to fit snugly over tilt rod 20. A projection 96 extends radially outward from circular base 94. Projection 96 is preferably wedge-shaped and has a predetermined thickness. Projection 96 may extend above top surface 34 of housing 30. Housing 30 includes a groove 38 in which cam 90 is located. Groove 38 extends within the housing such that cam 90 and its projection 96 may freely rotate. The groove 38 is preferably circular, but may be of any size and shape to accommodate full rotation of cam 90 and its projection 96 within housing 30.

Bores 32*a*, 32*b* intersect groove 38 along their length. Therefore, the adjustable rotation restrictors 40*a*, 40*b* may be adjusted through bores 32*a*, 32*b* into the area of groove 38. If the adjustable rotation restrictors are adjusted to a position close enough to top surface 34 of housing 30, they will restrict rotation of cam 90. Restricting rotation of cam 90 restricts rotation of tilt rod 20 because cam 90 is non-rotatably mounted to tilt rod 20. Restricting rotation of tilt rod 20 restricts relative movement of legs 72*a*, 72*b*, and therefore restricts tilt of cross rungs 74. Restricting tilt of cross rungs 74 restricts rotation of slats 60 since slats 60 rest upon cross rungs 74. Rotation of cam 90 is restricted when a side 96*a*, 96*b* of cam projection 96 abuts a top surface 42*a*, 42*b* of an adjustable rotation restrictor 40*a*, 40*b* to stop cam 90 from rotating. Adjustable rotation restrictors 40*a*, 40*b* may be adjusted up and down within their respective bores 32*a*, 32*b* by tool 50. The closer the adjustable rotation restrictors 40*a*, 40*b* are to top surface 34 of housing 30, the smaller the rotation range of cam 90, and therefore the smaller the rotation range of tilt rod 20, and resulting in a smaller the angular adjustment range of slats 60.

As can be seen in FIG. 6, rotation of cam 90 is restricted in the clockwise direction when a right side 96*b* of cam projection 96 abuts a top surface 42*b* of an adjustable rotation restrictor 40*b* to stop cam 90, tilt rod 20, and therefore slats 60 from rotating in the clockwise direction. The closer the righthand adjustable rotation restrictor 40*b* is to top surface 34 of housing 30, the smaller the rotation range of cam 90 in the clockwise direction, and therefore the smaller the rotation range of tilt rod 20 and slats 60 in the clockwise direction.

As can be seen in FIG. 7, rotation of cam 90 is restricted in the counter-clockwise direction when a left side 96*a* of cam projection 96 abuts a top surface 42*a* of an adjustable rotation restrictor 40*a* to stop cam 90, tilt rod 20, and therefore slats 60 from rotating in the counter-clockwise direction. The closer the lefthand adjustable rotation restrictor 40*a* is to top surface 34 of housing 30, the smaller the rotation range of cam 90 in the counter-clockwise direction, and therefore the smaller the rotation range of tilt rod 20 and slats 60 in the counter-clockwise direction.

Both adjustable rotation restrictors 40*a*, 40*b* may be adjusted (by tool 50) to an extreme top position (not shown), wherein rotation of cam 90 is completely restricted by adjustable rotation restrictors 40*a*, 40*b*. In addition, both adjustable rotation restrictors 40*a*, 40*b* may be adjusted (by tool 50) to an extreme bottom position (not shown), wherein rotation of the cam is completely unrestricted by the adjustable rotation restrictors 40*a*, 40*b*.

In use, a miniblind with a head rail according to the present invention can have the restricted rotation range set before or after the miniblind is mounted in a window. The rotation range can be set by inserting a tool, in the preferred embodiment a hex key, into one of the apertures 18*a*, 18*b* in the bottom of the head rail and through the respective bore

32*a*, 32*b* to engage the respective adjustable rotation restrictor 40*a*, 40*b* and move the adjustable rotation restrictor 40*a*, 40*b* up and down within the bore 32*a*, 32*b* to a desired position. Since access to the adjustable rotation restrictor is through the bottom of the head rail, the head rail need not be removed from its mounted position. In addition, the adjustable rotation restrictors 40*a*, 40*b* can be adjusted to fine tune the tilt range of the slats such that variation of the individual components of the miniblind within their tolerance limits can be compensated for, thus allowing increased uniformity among tilt ranges. Such fine-tuning also allows the customer to easily change the tilt range of the slats, even after they have been professionally installed, to meet desired tilt ranges.

Although the foregoing description has been provided for the presently preferred embodiment of the invention, the invention is not intended to be limited to any particular arrangement, but is defined by the appended claims. For example, the adjustable rotation restrictors may comprise unthreaded pegs which extend from the bottom of the housing through the bores and are frictionally retained in position within the bores, and are adjustable in a vertical direction by sliding the peg vertically within the bore. Therefore, no tool may be required. Also, the bores through which adjustable rotation restrictors are adjusted may extend diagonally into the housing. Alternative configurations of the invention, that may occur to those skilled in the art, are intended to form a part of the invention to the extent such alternatives fall within the scope of the appended claims.

What is claimed is:

1. A miniblind comprising:

a head rail;

a tilt rod disposed within the head rail;

a tilt actuator operatively connected to the tilt rod and operable to rotate the tilt rod; and a housing disposed in the head rail, the housing including;

a tilt rod rotational stop connected to the tilt rod and rotatable therewith, the stop having a protrusion with spaced apart, first and second, radially extending stop surfaces thereon, an adjustable rotation restrictor extending within the housing, for engagement with one of said stop surfaces when said tilt rod is rotated in one direction and engagement with the other stop surface when said tilt rod is rotated in the opposite direction, and, an access in said head rail in communication with said restrictor whereby said restrictor is capable of being adjusted externally of the head rail through said access to alter and restrict, depending upon its position, the arc of rotation of said stop and thus said tilt rod.

2. The miniblind as claimed in claim 1, wherein said adjustable rotation restrictor is adjustable to limit the tilt rod to an infinite number of restricted rotation ranges between about 0° and 180°.

3. The miniblind as claimed in claim 1, wherein said access for said adjustable rotation restrictor is through a side of the head rail.

4. The miniblind as claimed in claim 3, wherein said restrictor can be adjusted using an adjustment tool.

5. The miniblind as claimed in claim 4, wherein the adjustment tool is a hex key.

6. The miniblind as claimed in claim 1, including a second adjustable rotation restrictor.

7. The miniblind as claimed in claim 6, including a pair of threaded bores extending into the housing from a side thereof to a position adjacent to the stop, said rotation restrictors comprising threaded members for coactive threaded engagement within said bores whereby said restrictors may each be adjusted to move along a length of the threaded bores; each of said bores and restrictions being aligned with and for contacting separate ones of said stop surfaces.

8. The miniblind as claimed in claim 7, wherein said access comprises at least one aperture in a bottom side of the head rail and the threaded bores extend through a bottom side of the housing such that the threaded bores are aligned with said aperture in the bottom side of the head rail.

9. A tilt control mechanism for use in a miniblind having a head rail, a tilt rod rotatably attached thereto, at least one ladder, and a plurality of slats rotatably attached to the at least one ladder, the tilt control mechanism adjusting the minimum and maximum tilt angle of the slats and comprising:

a cam connected to the tilt rod for rotation therewith, the cam having a radially extending protrusion with spaced apart stop surfaces thereon; and at least one adjustable restrictor extending within the head rail for engagement with one of said stop surfaces when said stop is rotated in one direction and the other stop surfaces when rotatable in the opposite direction, wherein rotation of the tilt rod is restricted by abutment of the spaced apart stop surfaces against the at least one adjustable restrictor, and said cam positionable in a head rail aligned with an aperture in one wall thereof to permit access to said adjustable restrictor for adjustment thereof externally of said head rail.

10. The tilt control mechanism as claimed in claim 9, wherein the at least one adjustable restrictor is adjustable to limit the tilt rod to an infinite number of restricted rotation ranges between about 0° and 180°.

11. The tilt control mechanism as claimed in claim 9, wherein the adjustable restrictor can be accessed for adjustment from an exterior of the head rail through the bottom of the head rail.

12. The tilt control mechanism as claimed in claim 9, wherein the adjustable restrictor can be accessed for adjustment from an exterior of the head rail through the front of the head rail.

13. The tilt control mechanism as claimed in claim 9, wherein the adjustable restrictor can be adjusted using a single adjustment tool.

14. The tilt control mechanism as claimed in claim 13, wherein the adjustment tool is a hex key.

15. The tilt control mechanism as claimed in claim 11, including a second adjustable restrictor.

16. The tilt control mechanism as claimed in claim 15, wherein each of the adjustable restrictors comprise a threaded member extending into a threaded bore in the head rail to a position adjacent the cam, wherein the threaded member may be adjusted to move along a length of the threaded bore, and wherein said threaded bores are aligned with said aperture.

17. A method of adjusting tilt range restriction of a miniblind having a head rail with at least one aperture, a tilt rod extending within the head rail, and a tilt actuator operatively connected to the tilt rod and operable to rotate the tilt rod, the method comprising:

providing a cam housing disposed in the head rail, the cam housing including;

a cam non-rotatably connected to the tilt rod and rotating therewith, the cam having a protrusion; and at least one adjustable rotation restrictor extending within the housing and including at least one threaded bore extending into the cam housing from a side thereof to a position adjacent the cam, and at least one threaded member which can be adjusted to move along a length of the threaded bore, the bore being aligned with the at least one head rail aperture;

inserting a tool through the at least one head rail aperture and the at least one bore to engage the at least one threaded member;

actuating the at least one threaded member with the tool such that the threaded member moves along the length of the threaded bore; and restricting rotation of the tilt rod by abutment of the cam protrusion against the at least one adjustable rotation restrictor.

18. The method of claim 17, wherein the head rail aperture extends through a bottom portion of the headrail.

19. A miniblind comprising:

a U-shaped head rail;

a tilt rod mounted for rotation within the head rail;

a tilt actuator operatively connected to the tilt rod for effecting rotation thereto;

a housing disposed in the head rail, the housing including;

a tilt rod rotational stop connected to the tilt rod and rotatable therewith, the stop having a radially extending protrusion with spaced apart, first and second stop surfaces thereon, a pair of adjustable rotation restrictors extending within the housing for engagement with respective ones of said stop surfaces when said tilt rod is rotated in one or the other direction respectively;

and an aperture in said the bottom side of said head rail, and spaced apart threaded bores in said housing extending from a side thereof to a position adjacent the stop, said rotation restrictors comprising threaded members for coactive threaded engagement within said bores whereby the restrictors may each be adjusted to move along the length of the threaded bores;

said threaded bores extending through the bottom side of the housing and aligned with the aperture in the bottom side of the head rail to permit external adjustment of the restrictors through the aperture in the bottom wall of the head rail.

* * * * *